US006367580B1

(12) United States Patent
Chang

(10) Patent No.: US 6,367,580 B1
(45) Date of Patent: Apr. 9, 2002

(54) SOUND ADJUSTABLE TAIL PIPE STRUCTURE

(75) Inventor: Ming-Tien Chang, Fen-Yuan Hsiang (TW)

(73) Assignee: Liang Fei Industry Co., Ltd., Fen-Yuan Hsiang (TW)

( * ) Notice: Subject to any disclaimer, the term of this patent is extended or adjusted under 35 U.S.C. 154(b) by 0 days.

(21) Appl. No.: 09/613,757

(22) Filed: Jul. 11, 2000

(51) Int. Cl.[7] ..... F01N 7/18

(52) U.S. Cl. ..... 181/241; 181/227; 181/226; 181/219; 181/277

(58) Field of Search ..... 181/227, 228, 181/236, 237, 241, 248, 254, 271, 277, 278, 219, 226

(56) References Cited

U.S. PATENT DOCUMENTS 3,390,738 A * 7/1968 Kirsch et al. ..... 181/61
4,031,979 A * 6/1977 Raleigh ..... 181/69
4,715,472 A * 12/1987 McKee ..... 181/241
5,146,434 A * 9/1992 Bromley ..... 367/140

FOREIGN PATENT DOCUMENTS

JP 06273280 A * 9/1994 ..... G01M/15/00

* cited by examiner

*Primary Examiner*—Robert E. Nappi
*Assistant Examiner*—Edgardo San Martin
(74) *Attorney, Agent, or Firm*—Rosenberg, Klein & Lee

(57) ABSTRACT

A sound adjustable tail pipe structure includes an adjuster secured in a rear section of a tail pipe which defines a first oblong slot. The adjuster includes a tube having a first end provided with a first positioning base and a second end provided with a second positioning base, and an adjusting base rotatably mounted in the second positioning base. The first positioning base defines a first through hole connecting to the tube and has a wall defining a plurality of first guide holes. The second positioning base defines a second through hole connecting to the tube and has a wall defining a plurality of second guide holes, and a peripheral wall defining a second oblong slot. The adjusting base defines a third through hole connecting to the second through hole and has a wall defining a plurality of third guide holes aligning with each of the second guide holes, and a peripheral wall defining a screw hole. The adjusting bolt in turn extends through a washer, a C-shaped snap, the first oblong slot, the second oblong slot, and is screwed into the screw hole so that the adjusting base can be rotated by the adjusting bolt.

1 Claim, 4 Drawing Sheets

SOUND ADJUSTABLE TAIL PIPE STRUCTURE

FIELD OF THE INVENTION

The present invention relates to a sound adjustable tail pipe structure.

DESCRIPTION OF THE RELATED ART

A conventional muffler structure for the exhaust pipe of an ordinary car in accordance with the prior art comprises an auxiliary tail pipe locked to the rear section of a tail pipe of the car. The auxiliary tail pipe includes iron wires and a sound eliminating member mounted therein, and is punched with a sound eliminating hole so as to increase the air filtering effect and the noise eliminating effect.

However, the exhaust gas passing through the conventional muffler structure of the exhaust pipe has a fixed amount so that the conventional muffler structure of the exhaust pipe is only suitable for a certain kind of car so that the manufacturer and the fitting factory have to fabricate and store tail pipes of different regulations and sizes so as to fit the requirements of different kinds of cars, thereby greatly increasing the cost of fabrication.

In addition, the amount of noise created by the tail pipe will change due to different kinds of cars so that the conventional muffler structure of the exhaust pipe cannot be adapted to fit the noise eliminating requirements of different kinds of cars, thereby decreasing the versatility of the conventional muffler structure of the exhaust pipe.

SUMMARY OF THE INVENTION

In accordance with the present invention, there is provided a sound adjustable tail pipe structure comprising: an adjuster secured in a rear section of a tail pipe, wherein, the tail pipe defines a first oblong slot, the first oblong slot is provided for receiving an adjusting bolt, a washer, and a C-shaped snap;

the adjuster is substantially I-shaped and includes a tube having a first end provided with a first positioning base and a second end provided with a second positioning base, and an adjusting base rotatably mounted in the second positioning base, the first positioning base and the second positioning base each having an outer diameter slightly smaller than an inner diameter of the tail pipe;

the first positioning base defines a first through hole connecting to the tube and has a wall defining a plurality of first guide holes;

the second positioning base defines a second through hole connecting to the tube and has a wall defining a plurality of second guide holes, and the second positioning base has a peripheral wall defining a second oblong slot aligning with the first oblong slot of the tail pipe;

the adjusting base defines a third through hole connecting to the second through hole of the second positioning base and has a wall defining a plurality of third guide holes aligning with each of the second guide holes of the second positioning base, and the adjusting base has a peripheral wall defining a screw hole aligning with the second oblong slot of the second positioning base; and the adjusting bolt in turn extends through the washer, the C-shaped snap, the first oblong slot, the second oblong slot, and is screwed into the screw hole.

Further benefits and advantages of the present invention will become apparent after a careful reading of the detailed description with appropriate reference to the accompanying drawings.

DETAILED DESCRIPTION OF THE INVENTION

Figure 1:
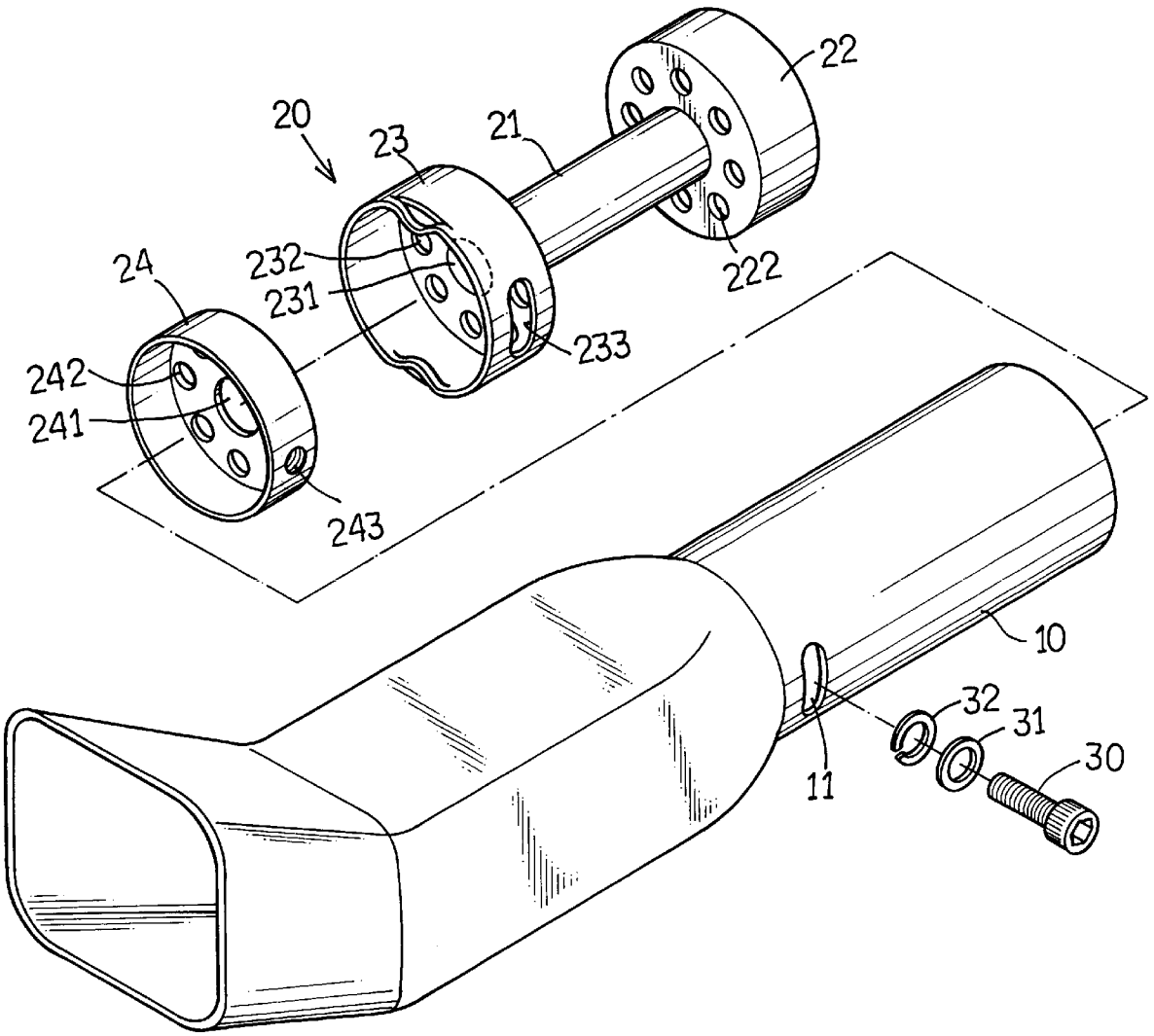
FIG. 1 is an exploded view of a sound adjustable tail pipe structure in accordance with the present invention.
Figure 2:
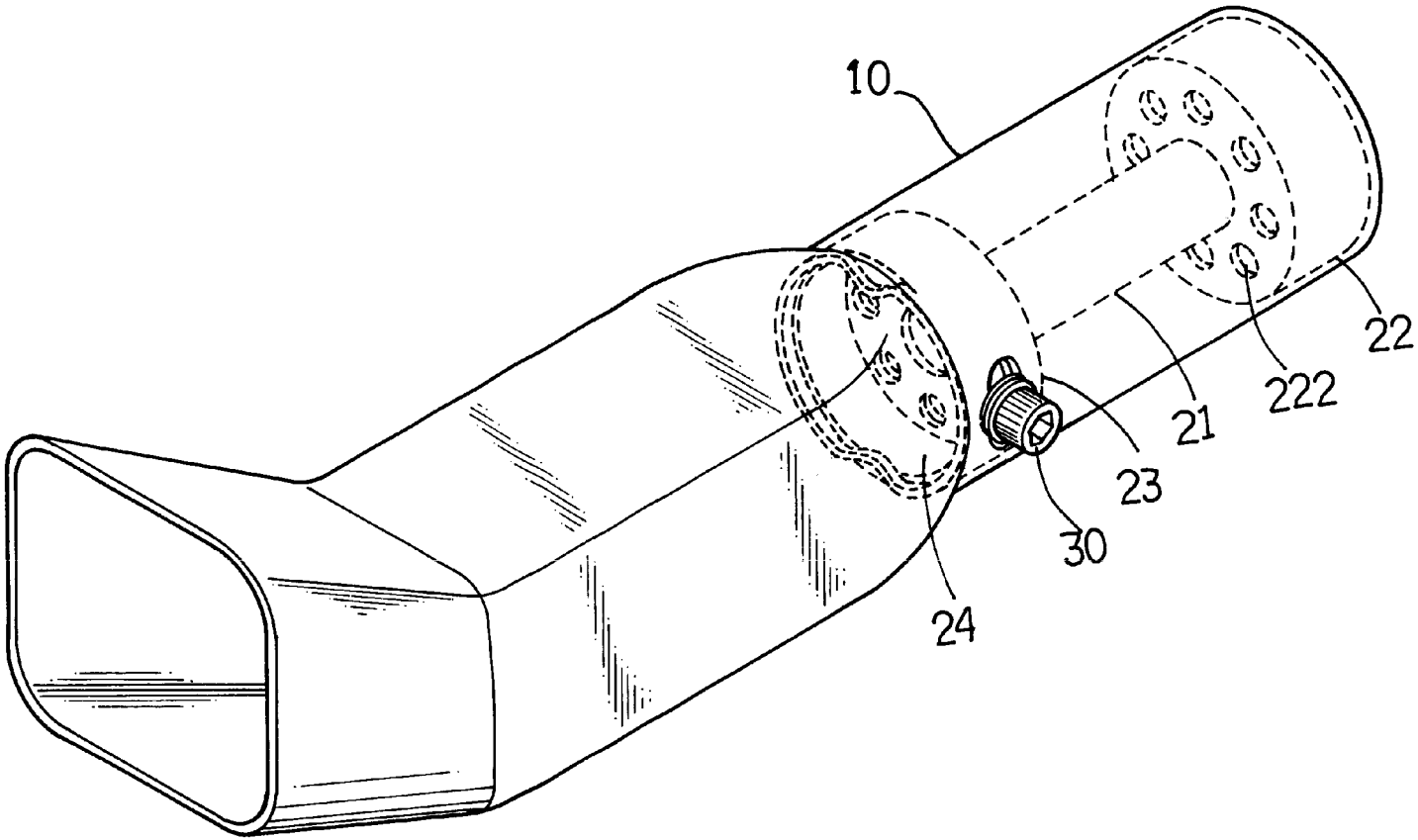
FIG. 2 is a perspective assembly view of the sound adjustable tail pipe structure as shown in FIG. 1.
Figure 3:
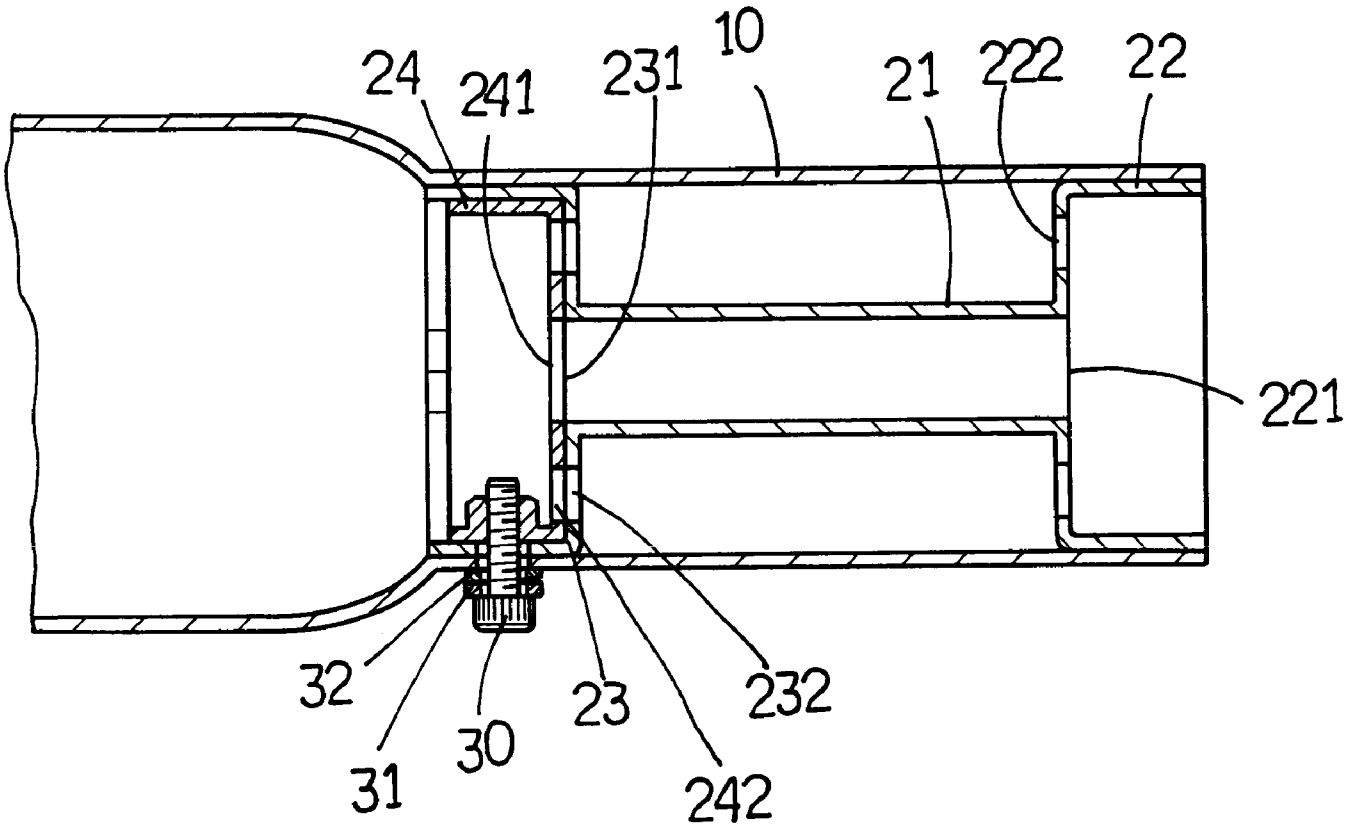
FIG. 3 is a partially cut-away top plan cross-sectional assembly view of the sound adjustable tail pipe structure as shown in FIG. 1.

Referring now to the drawings and initially to FIGS. 1–3, a sound adjustable tail pipe structure in accordance with the present invention comprises an adjuster 20 secured in the rear section of a tail pipe 10.

The rear section of the tail pipe 10 defines a first oblong slot 11 which is provided for receiving an adjusting bolt 30, a washer 31, and a C-shaped snap 32.

The adjuster 20 is substantially I-shaped and includes a tube 21 having a first end provided with a first positioning base 22 and a second end provided with a second positioning base 23, and an adjusting base 24 rotatably mounted in the second positioning base 23. The first positioning base 22 and the second positioning base 23 each have an outer diameter slightly smaller than an inner diameter of the tail pipe 10.

The first positioning base 22 defines a first through hole 221 (see FIG. 3) connecting to the tube 21 and has a wall defining a plurality of first guide holes 222.

The second positioning base 23 defines a second through hole 231 connecting to the tube 21 and has a wall defining a plurality of second guide holes 232. The second positioning base 23 also has a peripheral wall defining a second oblong slot 233 aligning with the first oblong slot 11 of the tail pipe 10.

The adjusting base 24 defines a third through hole 241 connecting to the second through hole 231 of the second positioning base 23 and has a wall defining a plurality of third guide holes 242 aligning with each of the second guide holes 232 of the second positioning base 23. The adjusting base 24 also has a peripheral wall defining a screw hole 243 aligning with the second oblong slot 233 of the second positioning base 23.

In assembly, the adjusting bolt 30 in turn extends through the washer 31, the C-shaped snap 32, the first oblong slot 11 of the rear section of the tail pipe 10, the second oblong slot 233 of the second positioning base 23 of the adjuster 20, and is screwed into the screw hole 243 of the adjusting base 24, thereby assembling the parts as shown in FIG. 1 into the sound adjustable tail pipe structure as shown in FIG. 2.

Figure 5:
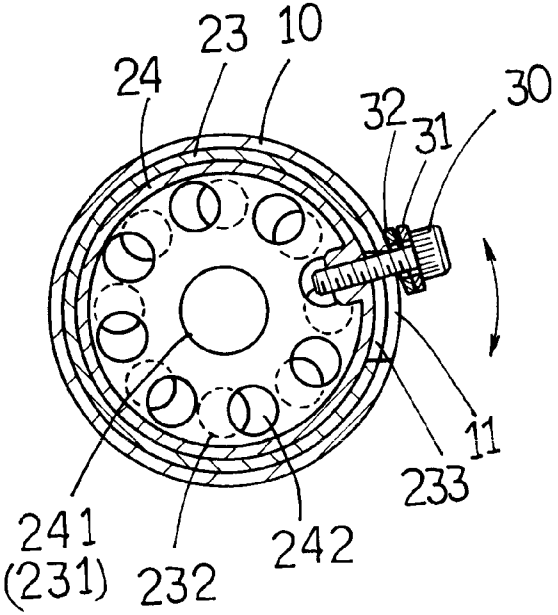
FIG. 5 is an operational view of the sound adjustable tail pipe structure as shown in FIG. 1.
Figure 4:
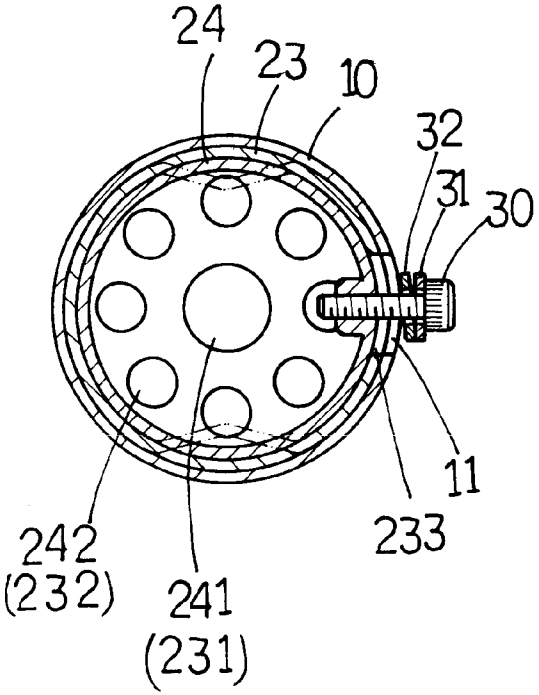
FIG. 4 is a side plan cross-sectional assembly view of the sound adjustable tail pipe structure as shown in FIG. 1.

In operation, referring to FIGS. 4 and 5 with reference to FIGS. 1–3, each of the third guide holes 242 of the adjusting base 24 entirely aligns with each of the respective second guide holes 232 of the second positioning base 23 as shown in FIG. 4. In such a manner, the intersecting area between each of the third guide holes 242 of the adjusting base 24 and each of the respective second guide holes 232 of the second positioning base 23 is to a greatest extent so that the exhaust gas passing through the adjuster 20 has the largest amount.

When the adjusting bolt 30 is displaced in the first oblong slot 11 of the rear section of the tail pipe 10, the adjusting base 24 can be rotated by the adjusting bolt 30 so that each of the third guide holes 242 of the adjusting base 24 partially aligns with each of the respective second guide holes 232 of the second positioning base 23 as shown in FIG. 5, thereby largely decreasing the intersecting area between each of the third guide holes 242 of the adjusting base 24 and each of the respective second guide holes 232 of the second positioning base 23, and thereby decreasing amount of the exhaust gas passing through the adjuster 20.

Accordingly, the amount of exhaust gas passing through the adjuster 20 can be arbitrarily adjusted by moving the adjusting bolt 30 along the first oblong slot 11 of the rear section of the tail pipe 10, thereby actually and efficiently adjusting the amount of exhaust gas and adjusting the level of the sound through the tail pipe 10 so that the sound adjustable tail pipe structure in accordance with the present invention can be adapted to suit the vehicles of various kinds.

It should be clear to those skilled in the art that further embodiments may be made without departing from the scope of the present invention.

What is claimed is:

1. A sound adjustable tail pipe structure comprising: an adjuster (20) secured in a rear section of a tail pipe (10), wherein, said tail pipe (10) defines a first oblong slot (11), said first oblong slot (11) is provided for receiving an adjusting bolt (30), a washer (31), and a C-shaped snap (32);

said adjuster (20) is substantially I-shaped and includes a tube (21) having a first end provided with a first positioning base (22) and a second end provided with a second positioning base (23), and an adjusting base (24) rotatably mounted in said second positioning base (23), said first positioning base (22) and said second positioning base (23) each having an outer diameter slightly smaller than an inner diameter of said tail pipe (10);

said first positioning base (22) defines a first through hole (221) connecting to said tube (21) and has a wall defining a plurality of first guide holes (222);

said second positioning base (23) defines a second through hole (231) connecting to said tube (21) and has a wall defining a plurality of second guide holes (232), and said second positioning base (23) has a peripheral wall defining a second oblong slot (233) aligning with said first oblong slot (11) of said tail pipe (10);

said adjusting base (24) defines a third through hole (241) connecting to said second through hole (231) of said second positioning base (23) and has a wall defining a plurality of third guide holes (242) aligning with each of said second guide holes (232) of said second positioning base (23), and said adjusting base (24) has a peripheral wall defining a screw hole (243) aligning with said second oblong slot (233) of said second positioning base (23); and said adjusting bolt (30) in turn extends through said washer (31), said C-shaped snap (32), said first oblong slot (11), said second oblong slot (233), and is screwed into said screw hole (243).

* * * * *